US012635832B2

(12) United States Patent
Droessler

(10) Patent No.: US 12,635,832 B2
(45) Date of Patent: May 26, 2026

(54) SHOWER BASE INSTALLATION METHODS AND DEVICES

(71) Applicant: KurbX, LLC, East Dubuque, IL (US)

(72) Inventor: Adam Michael Droessler, Galena, IL (US)

(73) Assignee: KurbX, LLC, East Dubuque, IL (US)

( * ) Notice: Subject to any disclaimer, the term of this patent is extended or adjusted under 35 U.S.C. 154(b) by 278 days.

(21) Appl. No.: 18/312,700

(22) Filed: May 5, 2023

(65) Prior Publication Data

US 2024/0366036 A1 Nov. 7, 2024

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01)

(58) Field of Classification Search
CPC . A47K 3/00; A47K 3/004; A47K 3/40; A47K 4/00; E03F 5/00; E03F 5/0407; E03F 5/0408
See application file for complete search history.

(56) References Cited

U.S. PATENT DOCUMENTS 8,918,926 B1 * 12/2014 Herring ..... E03F 5/0408 4/613
9,107,545 B1 * 8/2015 Herring ..... A47K 3/40
10,856,702 B2 12/2020 Droessler
11,272,683 B2 * 3/2022 Carvalho ..... A01K 1/011
11,284,751 B2 3/2022 Droessler
12,290,217 B2 * 5/2025 Welch ..... E03F 5/0408
2011/0088160 A1 * 4/2011 Stimpson ..... A47K 3/40 4/613
2014/0075666 A1 * 3/2014 Campbell ..... A47K 3/40 29/527.1
2015/0068145 A1 * 3/2015 Sjoden ..... E04B 5/02 52/302.1
2017/0280943 A1 * 10/2017 Schindler ..... A47K 3/1605
2017/0326615 A1 * 11/2017 Roy ..... A47K 3/40
2019/0104892 A1 * 4/2019 Liu ..... A47K 3/40
2020/0157794 A1 * 5/2020 Self ..... E03C 1/01
2021/0045588 A1 * 2/2021 Droessler ..... A47K 3/40
2023/0051458 A1 * 2/2023 Stout ..... B32B 3/30

OTHER PUBLICATIONS

Arc, Inc., Installation Instructions TrueDEK Classic, Mar. 2020, www.arcfirst.net.

* cited by examiner

*Primary Examiner* — Chi Q Nguyen
(74) *Attorney, Agent, or Firm* — Craig Fieschko; DeWitt LLP

(57) ABSTRACT

A drain support block is configured to support a drain body during installation of a shower base, thereby easing problems commonly encountered when the drain body is misaligned, misoriented, or sagging during shower base installation. The drain support block may be cut to fit between floor joists with the supported drain body resting at any location between the joists, thereby allowing the support block to be rapidly resized for attachment between joists to situate the drain body at any desired location for the drain hole of the shower base. The support block also beneficially supports the bottom of the shower base about its drain hole, thereby deterring breakage of the shower base about the drain hole when shower users stand thereupon.

18 Claims, 8 Drawing Sheets

100
102
102o
108
110
104
102
102o
104
106
150
152
154
156
152
154
150
156

SHOWER BASE INSTALLATION METHODS AND DEVICES

FIELD OF THE INVENTION

The invention relates generally to the installation of preformed shower bases.

BACKGROUND OF THE INVENTION

A shower base (also referred to as a shower pan, shower tray, shower floor, or "former") is the portion of a shower upon which a user stands when taking a shower. A shower base is typically provided "preformed," that is, as a sheet or pan-like structure having a drain hole formed therein, and which is installed atop or adjacent the surrounding (sub)floor with its drain hole operatively connected to a waste line beneath. The shower walls are then typically constructed about the shower base, which may itself be tiled over or otherwise covered for cosmetic or other purposes (e.g., to deter a user's slippage when taking a shower).

Shower base installation is a major component of the overall cost of a shower owing to time required and difficulties encountered with installation, and the number of personnel/trades involved. Installation may require licensed and insured personnel such as a carpenter (to cut the floor where the shower base is to be laid atop the joists supporting the floor, or to cut the hole allowing connection of the waste line where the shower base is laid atop the floor), a plumber (to connect the drain hole to the waste line after construction or rerouting of the waste line), and a tiler or other finisher (where the shower base is to be further enhanced after installation), and the scheduling/staging of their respective tasks must be coordinated for efficiency. When personnel have access to the shower base from beneath—as where a shower is being installed on the ground floor of a home, with access to the drain hole being allowed from an unfinished basement ceiling—installation is greatly eased, as the floor can be cut to allow the shower base to rest atop the floor joists supporting the floor (or the shower base might simply be laid atop the floor once an appropriately-located hole is cut in the floor beneath the drain hole), and a plumber can then connect the waste line to the drain hole from the basement. However, where installation occurs on floors that do not allow access to the drain hole from beneath the shower base, it can be difficult and time-consuming to obtain a water-tight connection of the drain hole to the waste line. This increases plumbing costs, and can disrupt the staging of tasks scheduled to occur following installation of the shower base.

U.S. Pat. Nos. 10,856,702 and 11,284,751 describe drain hole connection assemblies that can greatly ease connection of the drain hole to the waste line. The waste line, which typically extends horizontally between adjacent floor joists and then vertically upwardly to an open end to be connected to the drain hole, has a drain body installed in water-tight fashion about the outer circumference of the waste line's upwardly-facing end. This drain body provides an internally-threaded terminal for the waste line. The shower base is situated atop the floor joists (or floor) such that its drain hole is aligned with the drain body. A short internally and externally threaded conduit having an upper flange—referred to as a "flange nipple"—is then inserted through the drain hole and screwed into the internal threading of the drain body, with its upper flange pressing against the shower base about the perimeter of the drain hole. This effectively connects the shower base drain hole to the waste line. A drain gate frame, which bears a screen/grating, is then threaded into the flange nipple to complete the shower drain.

Assemblies of this nature can greatly reduce the time and cost of connection of the drain hole to the waste line, but problems can still arise, typically from misalignment of the end of the waste line with the drain hole. The waste line may be unsupported and sagging as it extends between the floor joists, and its end may be situated several inches below the floor/subfloor, requiring that it be lifted to effect connection of its end to the aforementioned flange nipple (or other drain hole components). Such lifting is not easily achievable with the shower base resting over the floor joists. Additionally or alternatively, the final length of the waste line might extend at an angle from the vertical, which can make connection to the flange nipple (or other drain hole components) difficult. Furthermore, a gasket is typically fit atop the drain body before affixing it to the bottom of the shower base to better ensure a water-tight conduit is formed from the shower base drain hole to the waste line. When the shower base is situated over the floor joists and efforts are made to affix the misaligned waste line (and its drain body) to the drain hole, this gasket may be dislodged from the drain body. This frustrates the installer, who then needs to remove the shower base to retrieve and reset the gasket, and restart installation efforts.

SUMMARY OF THE INVENTION

The invention, which is defined by the claims set forth at the end of this document, is directed to a drain support block, an associated method of installation, and a resulting assembly which at least partially alleviate the aforementioned problems. The following brief summary of the invention provides a basic understanding of some of the features of preferred versions of the invention, with more details being provided elsewhere in this document. To assist in the reader's understanding, the following review makes reference to the accompanying drawings (which are briefly reviewed in the "Brief Description of the Drawings" section following this Summary section of this document).

FIG. 1 depicts an exemplary drain support block 100 which significantly eases installation of a shower base, more particularly, by reducing the difficulties encountered when attempting to connect the shower base drain hole to the shower waste line. The drain support block 100 has opposing block ends 102 with a block length extending therebetween; opposing block sides 104 with a block width extending therebetween; and opposing block faces 106 with a block depth extending therebetween. The support block 100 is preferably provided to an installer with an "oversized" block length (as exemplified by the phantom/dashed-line portions) such that it may be cut along the block width to adjust the block length from exemplary original block ends 1020 to installer-determined block ends 102. A block hole 108 extends between the block faces 106, and preferably has a surrounding countersink 110 defined in at least one of the block faces 106. The drain support block 100 is depicted with a pair of optional cleats 150, the use of which will be described below.

FIGS. 2*a*-2*d* then depict the installation and use of the drain support block 100. FIG. 2*a* shows an exemplary area at which a shower is to be installed (more particularly, a floor 200 wherein or whereupon a shower base is to be installed at an installation area 202, and the frame 300 of an adjacent wall whereupon a shower wall might be mounted). In FIG. 2*b*, an installer has cut away a floor section 204 corresponding to the installation area 202, exposing the floor joists 206 beneath (which, in US construction, are typically situated such that their centers are spaced 16 inches apart, such that the sides of adjacent floor joists 206 are approximately 14½ inches apart). This is typically done by the installer's placement of the shower base (shown at 400 in FIG. 2*f*) atop the installation area 202 and marking (tracing) the shower base's perimeter onto the floor 200 with a pencil or other marker, and then removing the shower base and cutting along the marking. Before removing the shower base, the installer may likewise trace the shower base's drain hole (shown at 402 in FIG. 2*f*) onto the floor 200 and measure its distance to surrounding features such as the walls 300 and/or the traced shower base perimeter, allowing the installer to easily map the intended (marked) drain hole location once the shower base (and the floor section 204) is removed (that is, the installer can determine the drain hole location with respect to surrounding features). Alternatively, the installer can perform such mapping with respect to the shower base's drain hole when the shower base is situated atop its installation area 202.

In FIG. 2*c*, the installer then places the drain support block 100 (here shown in its uncut/oversized form) such that the block hole 108 is situated at the mapped drain hole location, preferably with the drain support block 100 resting upon, and its block length extending between, the adjacent floor joists 206 on the opposing sides of the drain hole location. The installer can then mark one or both of the block faces 106 at block cutting locations situated immediately adjacent the floor joists 206 (e.g., a pencil or other marker can be traced along the joists and onto the lower block face 106 in FIG. 2*c*). The installer may then cut the block across the block width at these block cutting locations, thereby adjusting the block length such that the drain support block 100 may closely fit between the adjacent floor joists 206. This can be easily accomplished by situating the drain support block 100 atop the joists such that the marked block cutting locations are readily visible, and then using a circular saw or other cutting tool to cut the drain support block 100 at these locations (being careful to avoid cutting any joists 206 while doing so).

The drain support block 100 can then be fit between the adjacent floor joists 206, and each block end 102 can be attached to a respective one of the adjacent floor joists 206. (Preferably, any adaptation of the waste line 208 is done before this step, else the presence of the installed drain support block 100 may hinder adaptation of the waste line 208.) The installation of the drain support block 100 is preferably done using the cleats 150 of FIG. 1 in the manner shown in FIG. 2*d*. Referring to FIG. 1, each cleat 150 has a cleat support surface 152 bounded by opposing cleat side surfaces 154. Each cleat 150 has one of its cleat side surfaces 154 affixed to a respective one of the floor joists 206 such that the cleat support surfaces 152 can support the drain support block 100 between the adjacent joists 206, preferably such that the top block face 106 rests in the same plane as the tops of the joists 206. An installer can easily locate the cleats 150 in this manner by, for example, situating one of the cut-off portions of the drain support block 100 against a joist 206 such that its top face is level with the top of the joist 206; situating the cleat 150 beneath and against this portion and against the joist 206; and then screwing, nailing, or otherwise fastening the cleat 150 to the joist 206. The drain support block 100 can then be fit between the adjacent floor joists 206 with each block end 102 resting atop a respective one of the cleat support surfaces 152, and can be nailed or otherwise fastened to the cleats 150 (and/or directly to the joists 206, particularly if the cleats 150 are not used).

The drain support block 100 is therefore fixed between the adjacent floor joists 206 as shown in FIG. 2*e*, with the block hole 108 aligned with the intended location of the drain hole 402 of the to-be-installed shower base 400. A drain body 210 can then be fit within the block hole 108 until its drain body upper flange 212 rests within the countersink 110, and can thereafter be connected to the waste line 208.

As seen in FIG. 2*f*, the shower base 400 can then be placed in the installation area 202 atop the drain support block 100 and floor joists 206 therein. The drain hole 402 of the shower base 400 should then be in alignment with the drain body 210, which is firmly held in place, thereby greatly easing subsequent installation of a flange nipple and/or other drain hole connection components. Preferably, prior to placement of the shower base 400, a suitable gasket (not shown) is situated atop the drain body upper flange 201 to better form a water-tight seal between the drain hole 402 and the waste line 208, and adhesive may be applied to the top block face 106 and the tops of the joists 206 to better secure the shower base 400 thereon.

The support block 100 therefore allows for easy connection of a shower base drain hole 402 to a drain body 210 and its waste line 208, as a user should not encounter a misaligned, sunken, or deflecting drain body 210. Moreover, the support block 100 decreases the chance that a gasket atop the drain body 210 will be dislodged during connection, and beneficially supports the shower base 400 about its weakest portion (about the drain hole 402), decreasing the likelihood that the shower base 400 will later crack about the drain hole 402 after use. Further potential advantages, features, and objectives of the invention will be apparent from the remainder of this document in conjunction with the associated drawings.

DETAILED DESCRIPTION OF EXEMPLARY VERSIONS OF THE INVENTION

Figure 1:
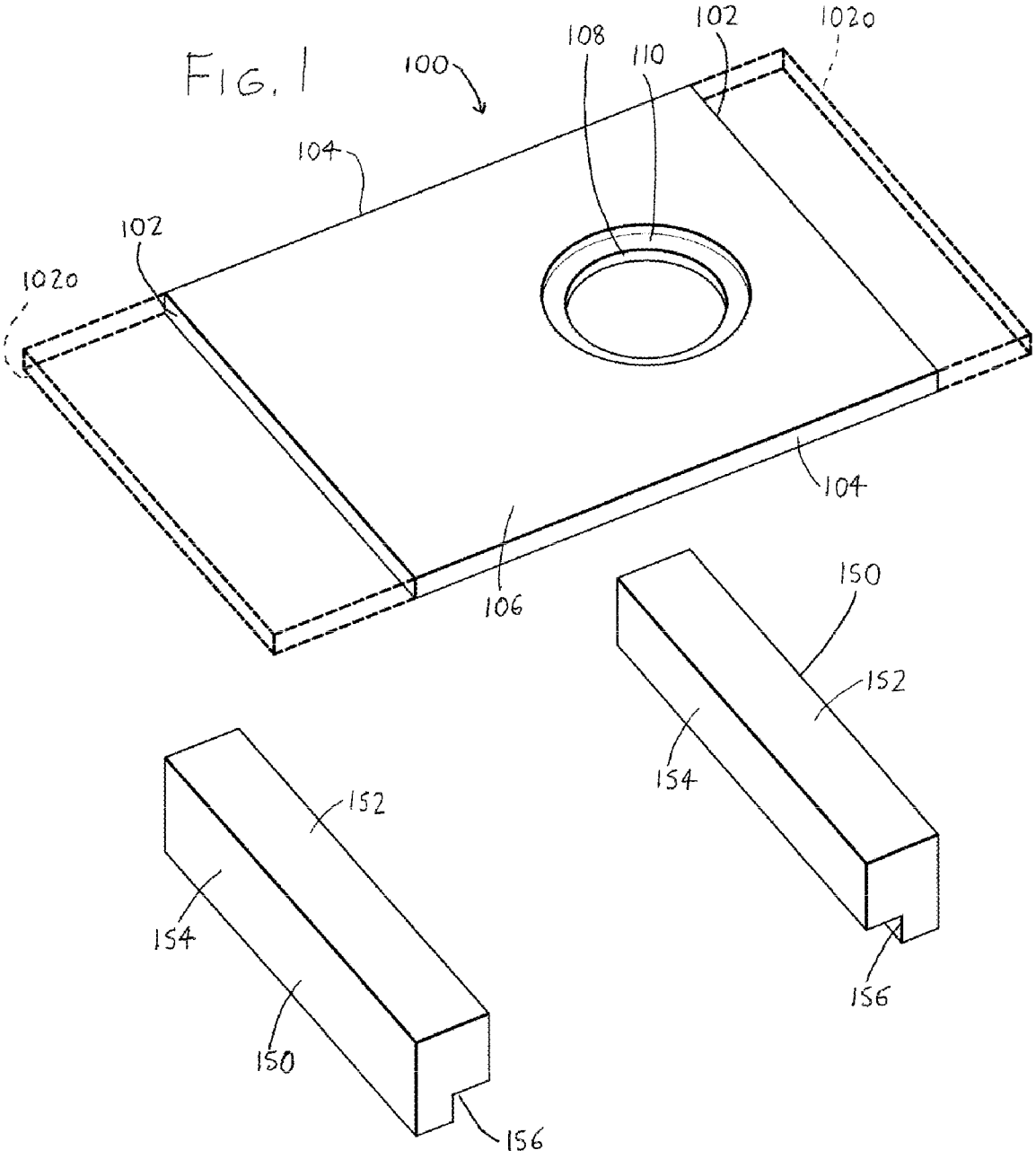
FIG. 1 is an isometric view of an exemplary drain support block 100 and cleats 150 that might be used to affix the support block 100 between adjacent floor joists, with the block being shown with its block length cut from original block ends 1020 to final block ends 102.

Expanding on the discussion above, the drain support block 100 is preferably formed of cuttable material, with the term "cuttable material" here being used to refer to any material readily cuttable by common hand-held power or manual cutting tools, e.g., circular saws or crosscut or rip-cut saws). Engineered wood (e.g., particle board, chipboard or fiberboard) is a particularly preferred material for the drain support block 100, but other materials such as natural wood (preferably an inexpensive, softer and more easily cut wood such as pine), plastic (e.g., recycled plastic lumber or high-density foamboard), or composite materials (primarily cellulose/wood and/or polymer-based composites for sake of cost, cuttability, and durability) could be used. The material used for the drain support block 100 may be treated to deter rot, fungal decay, and/or termite or other insect infestation, a measure which is particularly preferred where the block 100 is to be installed between concrete joists 206 or otherwise in a space which may be more susceptible to moisture accumulation.

An exemplary preferred version of the drain support block 100 has a block length of 21 inches between the block ends 102, a block width of 11¾ inches between the block sides 104, and a block depth of ⅝ inches between the block faces 106. The block hole 108 preferably has an outer diameter sized slightly greater than the upper section of the drain body 210 to be fit in the block hole 108, e.g., an outer diameter of 3⅞ to 4 inches (assuming a typical drain body upper section outer diameter of 3¾ inches). The block hole 108 is then situated with its center 7¼ inches from one of the block ends 102 (that is, with its outer diameter spaced 5⁵⁄₁₆ inches from this block end 102), and equally spaced from each of the block sides 104. It is notable that these dimensions allow the support block 100 to be cut to situate the block hole 108 (and thus a drain body 210 and waste line 208) situated at practically any location between joists 206 conventionally spaced 16 inches between centers (that is, having a distance between joists 206 of roughly 14.5 inches), including situations where the waste line 208 nearly abuts a joist 206 (with any interfering cleat 150 then being notched to accommodate the drain body 210).

The block length can be extended, and the block hole 108 repositioned, if the drain support block 100 is instead to be used with joists 206 having 19-inch or 24-inch spacing (and thus roughly 17½ or 22½ inch joist-to-joist spacing). Likewise, the block hole 108 may be differently dimensioned if it needs to accommodate a differently-sized drain body 210, e.g., one fit for a smaller waste line 208. (Typical shower waste lines 208 have a 2-inch outer diameter, though a shower waste line may have a 1.5-inch outer diameter where the waste line was originally used for a bathtub, as bathtubs typically use 1.5 inch waste lines.) Beneficially, a cuttable support block 100 is typically also sufficiently "soft" that a drain body 210 having threading about its upper portion (below its upper flange 212) can be threaded into the material about the block hole 108, with the threading gripping the perimeter of the block hole 108. However, it is preferred that the block hole 108 allows some degree of "play" for a drain body 210 inserted therein, as it is often useful to be able to make small adjustments to the location of the drain body 210 during connection to the shower base drain hole 402.

Figure 2A:
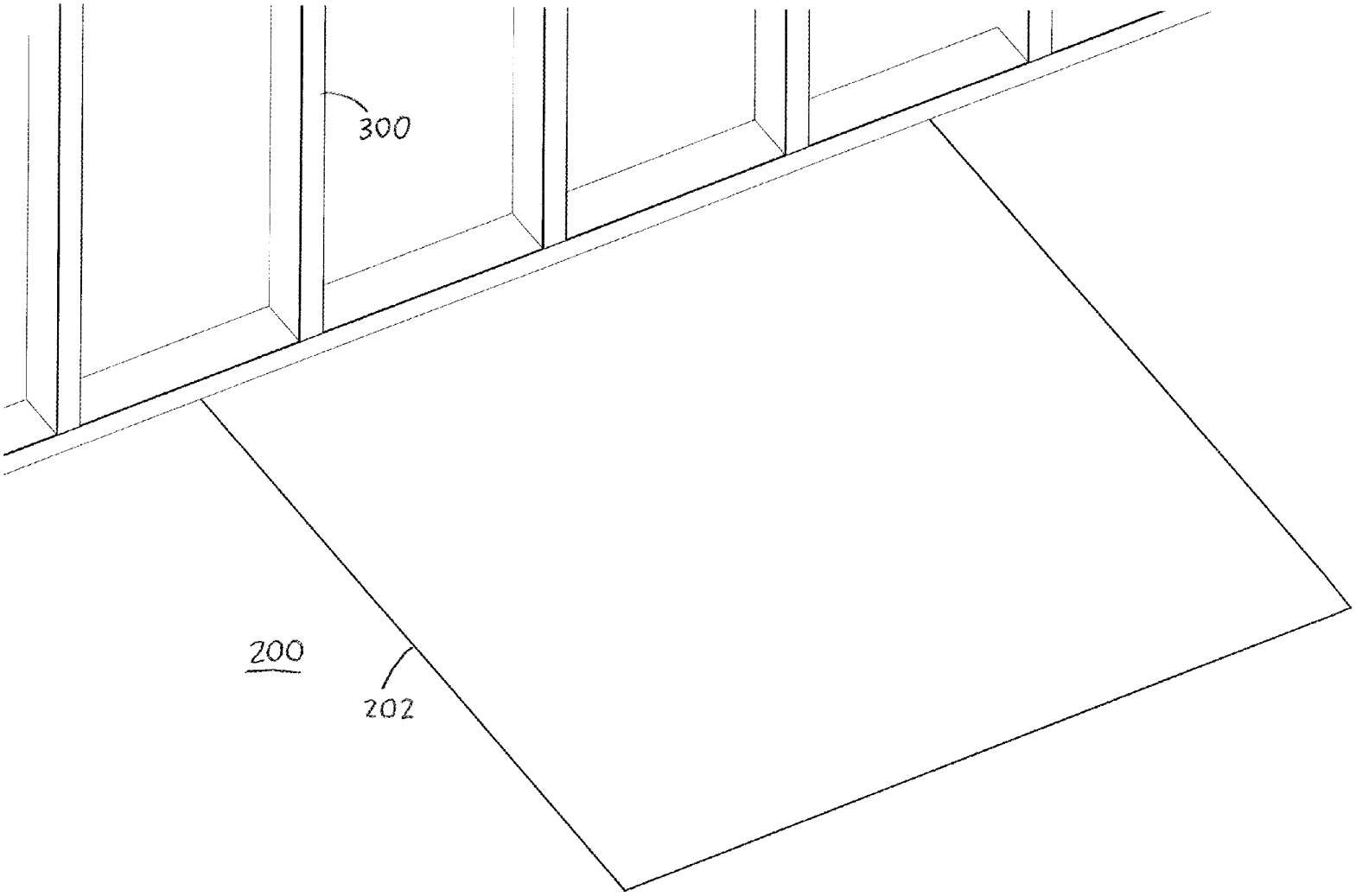
FIG. 2*a* depicts an exemplary area of a room at which a shower might be installed.
Figure 2B:
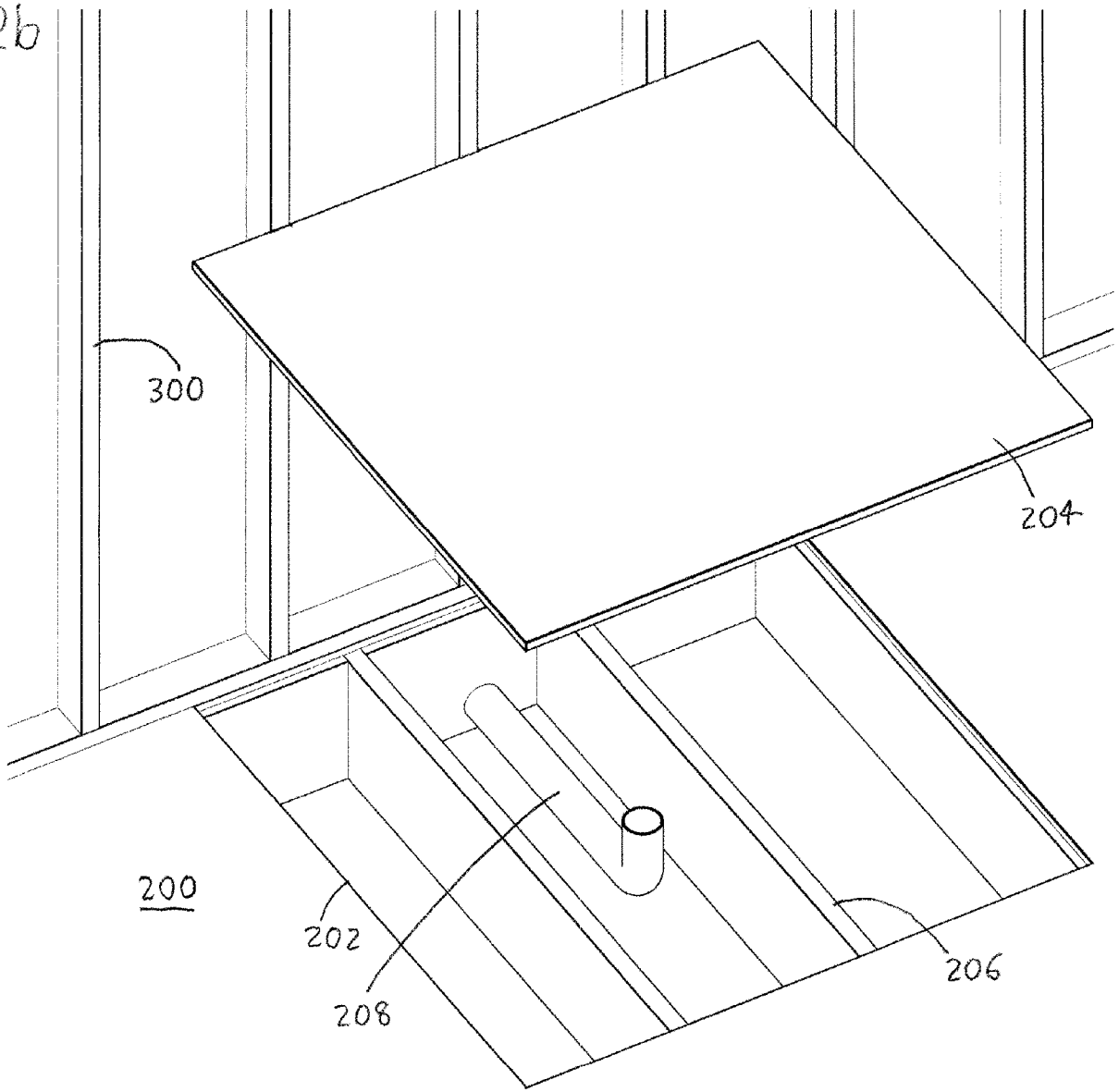
FIG. 2*b* shows the area of FIG. 2*a* after a shower base installation area 202 is formed by removal of a section 204 of the floor 200.
Figure 2C:
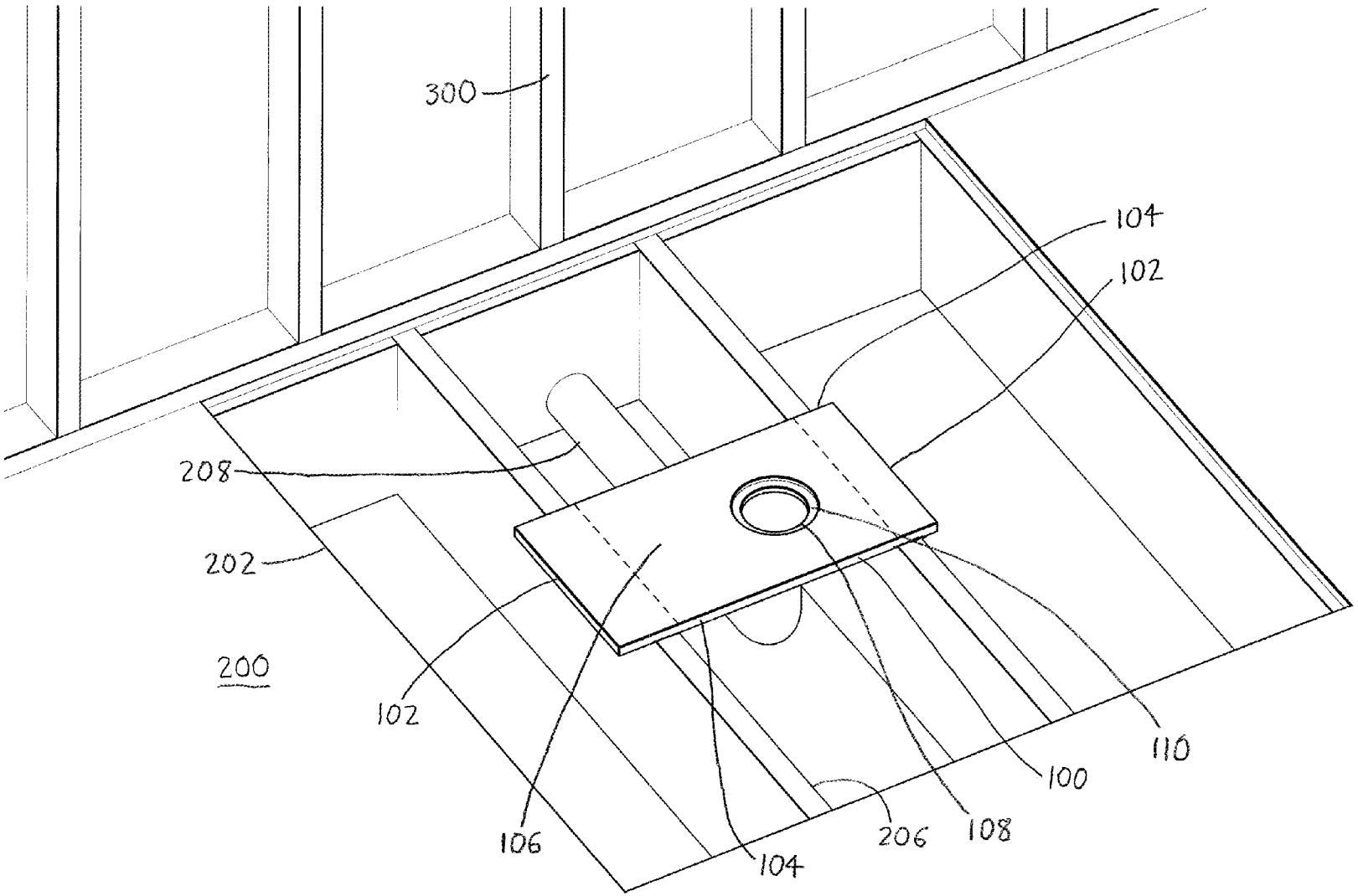
FIG. 2*c* shows placement of the support block 100 such that its block hole 108 is aligned with the intended location of the drain hole of a to-be-installed shower base, allowing an installer to mark the support block 100 for cutting such that the support block 100 will fit between adjacent floor joists 206.
Figure 2D:
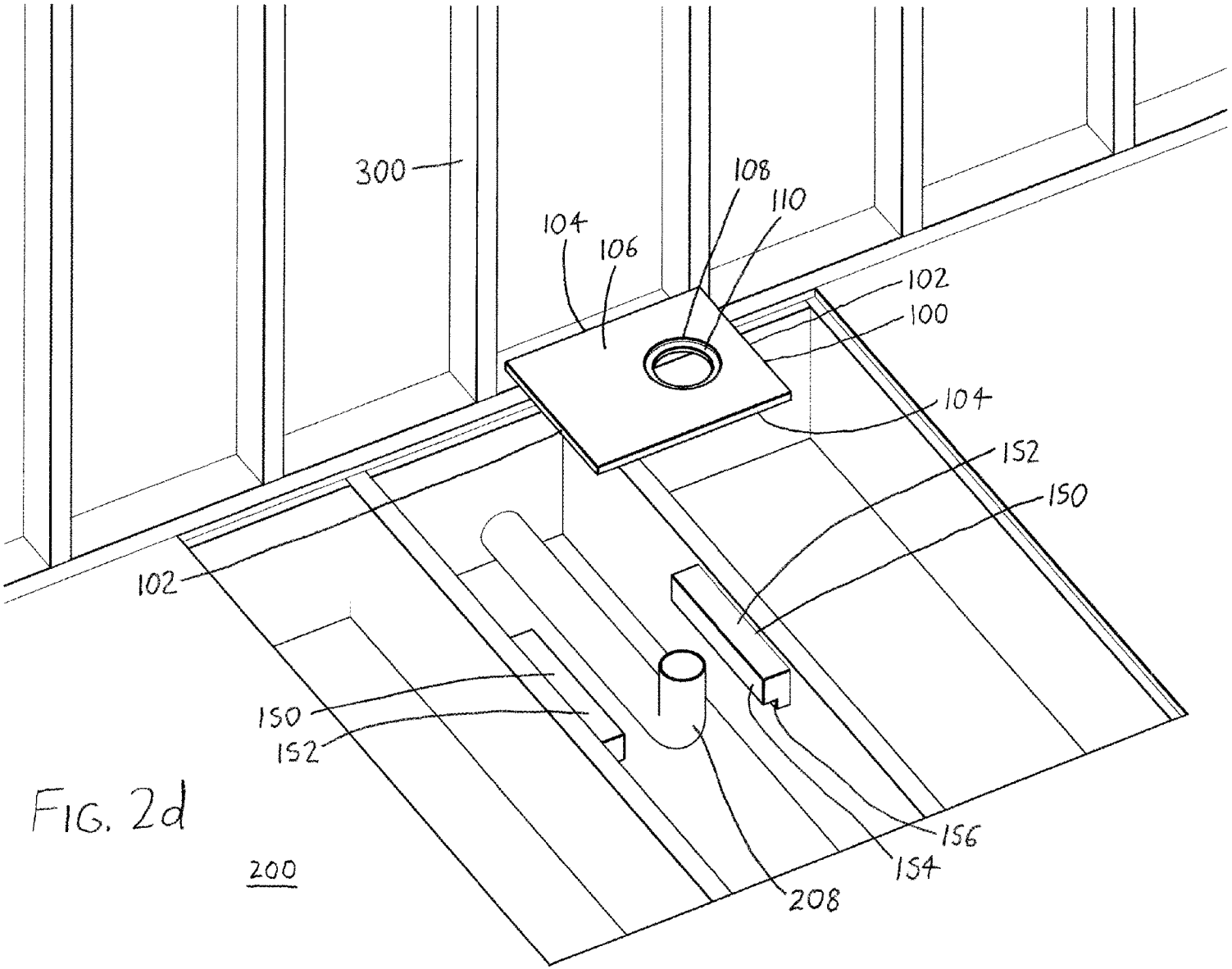
FIG. 2*d* shows the cleats 150 installed on the floor joists 206 such that they may support the support block 100 for easy attachment between the joists 206.
Figure 2E:
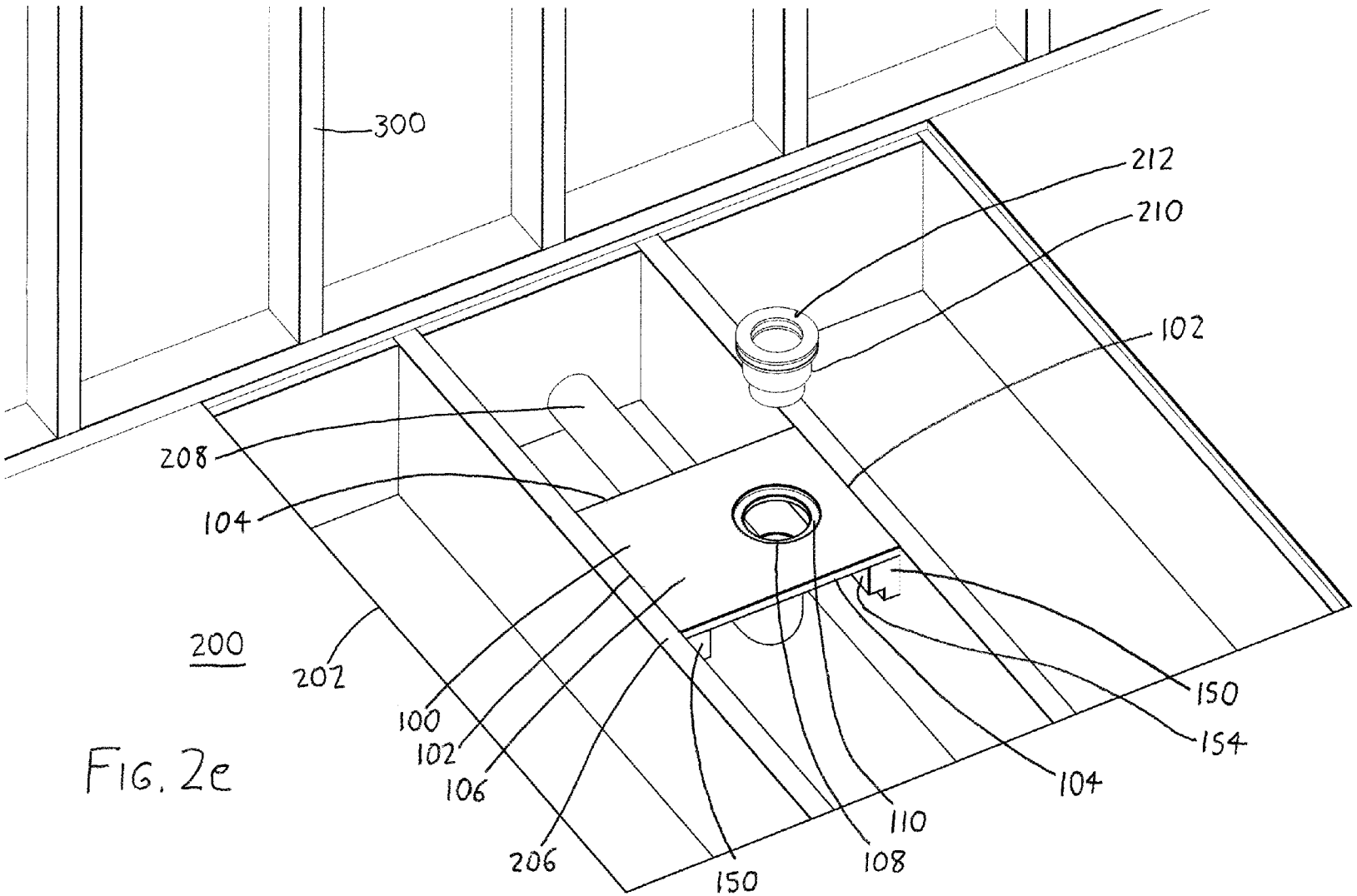
FIG. 2*e* shows the support block 100 fixed between the joists 206 to receive a drain body 210 within its block hole 108.
Figure 2F:
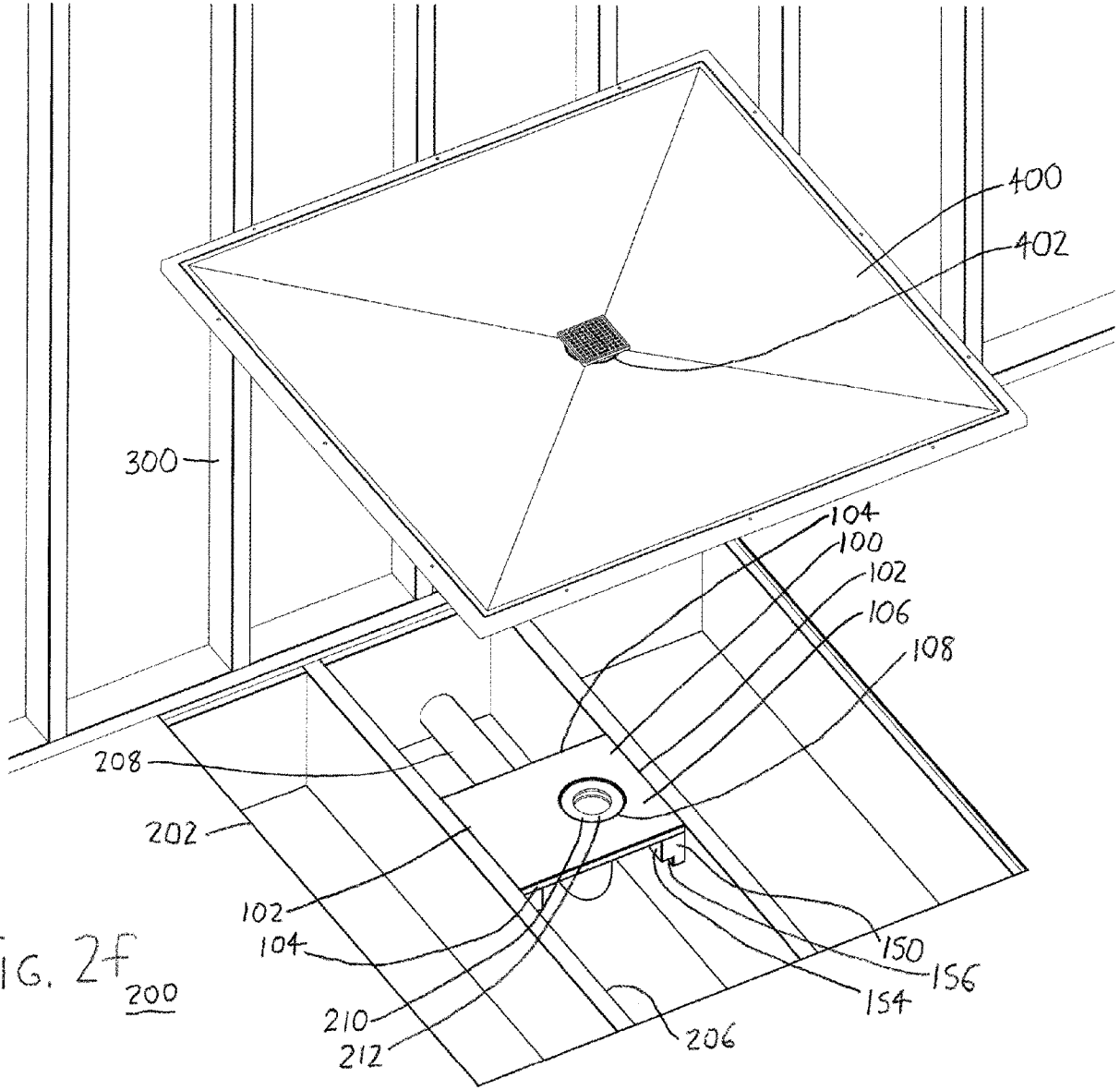
FIG. 2*f* shows a shower base 400 to be installed atop the support block 100, with the shower base drain hole 402 thereafter being aligned with the drain body 210 supported by the support block 100.
Figure 3:
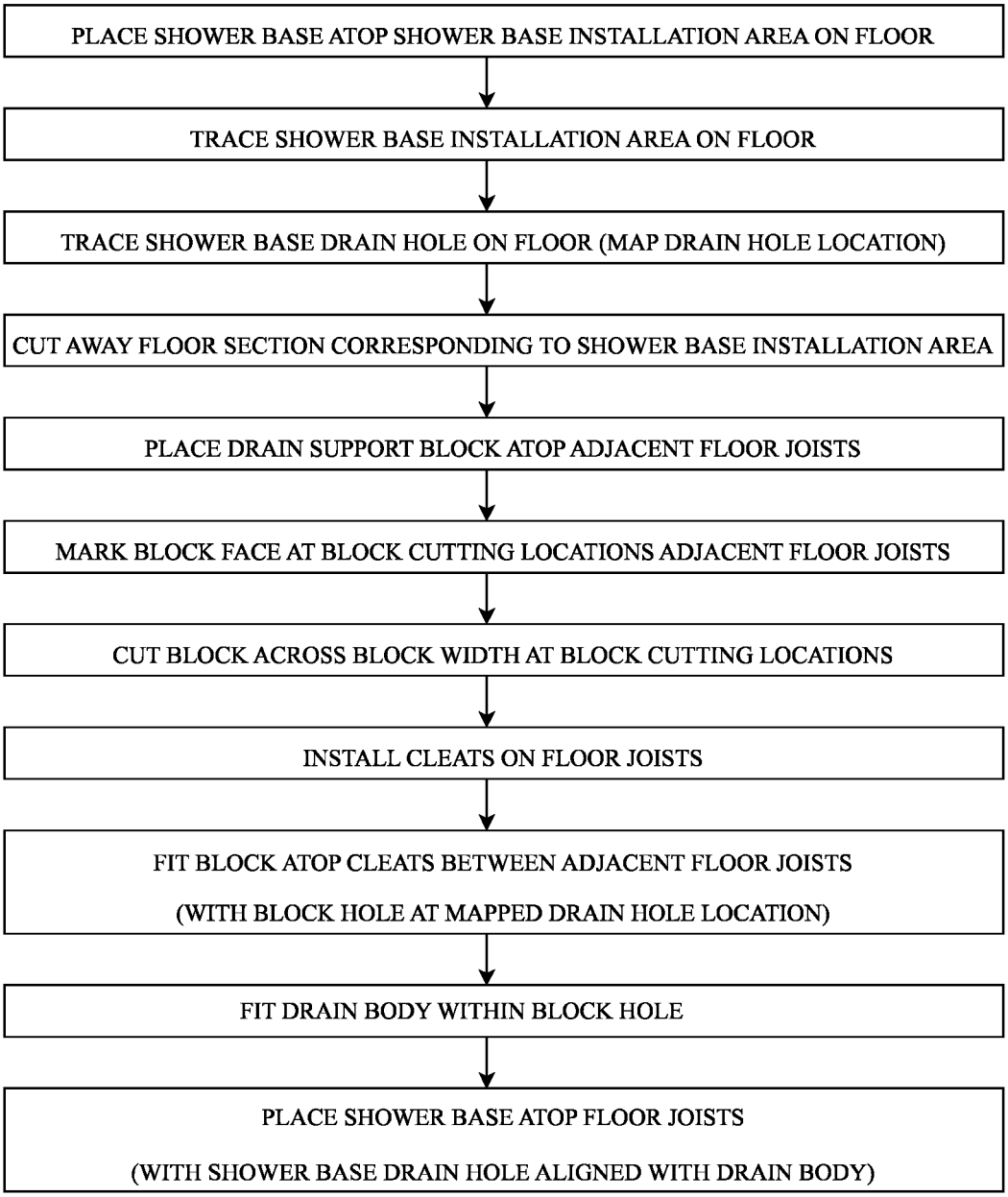
FIG. 3 is a flowchart illustrating steps of an exemplary method for installation of the drain support block.

The countersink 110 in the upper block face 106 about the block hole 108 is then sized to receive the drain body upper flange 212 as shown in FIGS. 2*e* and 2*f*. The upper surface of the flange 212 thereafter preferably rests slightly below the upper block face 106, thereby better retaining a gasket atop the flange 212. The countersink 110 thus might have an outer diameter of 5 inches and a depth of ⁵⁄₁₆ inches (accommodating a drain body flange extending ½ inches outwardly from the aforementioned 3¾ inch diameter of the upper section of a conventional drain body 210, and having a flange depth of ¼ inch). Here too dimensions may be altered to accommodate differently-sized drain body upper flanges.

Each cleat 150 is preferably rabbeted between at least one of its cleat support surfaces 152 and at least one of its cleat side surfaces 154, as seen in FIG. 1. The rabbet 156 is useful where the installer encounters floor joists in the form of "I-joists," that is, joists formed in the shape of I-beams (typically having a central elongated vertically-oriented strip of engineered wood capped at its upper and lower lengthwise edges by beams of natural wood). In this case, a cleat 150 may be rotated from its orientation shown in FIG. 1 so the rabbeted cleat support surface is at the top of the cleat 150, with the rabbet 156 facing the I-joist to which the cleat 150 is to be affixed. The rabbet 156 is dimensioned such that the adjacent cleat side surface 154 may be situated in abutment with the central strip of the I-joist, with the I-joist's upper capping beam fit within the rabbet 156, and with the cleat support surface 154 then being spaced from the top of this capping beam by the depth of the drain support block 100. The rabbets 156 therefore allow the cleats 150 to affix to I-joists in a manner analogous to the arrangement of FIG. 2*d*. The cleats 150 may be formed of any suitable material, such as the aforementioned materials used for the drain support block 100, with natural wood being particularly preferred (and more particularly treated lumber where the cleats 150 are to be affixed to concrete).

While the support block 100 is shown as a rectangular prism with a circular block hole 108, the configuration of the block 100 and hole 108 may vary from these forms so long as the block 100 is capable of supporting a drain body 210 between adjacent joists 206.

Installation of the support block can involve other, more, or fewer steps than those described above, and steps may be performed in any suitable order. As an example, the installation of the drain support block 100 as shown in FIGS. 2*a*-2*f* assumes that the installer is installing the shower base 400 directly atop the floor joists 206, as is commonly done where a "curbless" shower is to be constructed (that is, a shower having a shower base 400 which is roughly level with the surrounding floor 200, rather than elevated with respect to the floor 200). However, the invention is also useful where the shower base 400 is to be installed atop the floor 200. In this case, an installer need not remove the entire floor section 204 corresponding to the installation area atop which the shower base will rest, and might remove only so much floor 200 as is needed to perform necessary plumbing work on the waste line 208 (e.g., installation/rerouting) and to install the drain support block 100. In other words, the steps shown in FIG. 2*c* onward might be performed where only a portion of the floor 200 is removed, rather than the entire floor section 204 of FIG. 2*b*.

Throughout this document, where a measurement or other value is qualified by the term "substantially," "approximately," "about," or the like—for example, "substantially concentric"—this can be regarded as referring to a variation of 10% from the relevant state or value. Thus, as an example, "substantially concentric" apertures can be understood to refer to apertures having centers that may be offset by as much as 10% of the distance between the apertures' centers when the apertures are moved to locations where they are no longer overlapping, but are still immediately adjacent one another.

The invention is not intended to be limited to the preferred versions of the invention described above, but rather is intended to be limited only by the claims set out below. Thus, the invention encompasses all different versions that fall literally or equivalently within the scope of these claims. No term(s) expressed within any claim is to be construed in accordance with 35 U.S.C. 112(f) unless the words "means for" or "step for" are explicitly used in the claim in question.

What is claimed is:

1. A method of using a drain support block formed of cuttable material, the block having:

a. a block length extending between opposing block ends, the block length being at least 18 inches and at most 24 inches, b. a block width of at least 6 inches extending between opposing block sides, the block sides extending between the block ends, c. a block depth of at least 0.5 inches extending between opposing block faces, the block faces extending between the block ends and block sides, d. a block hole extending between the block faces, the method including the steps of:

a. cutting the block across the block width to adjust the block length to closely fit between adjacent floor joists whereupon a shower base is to be installed, b. fitting the block between the adjacent floor joists with each block end resting closely adjacent a respective one of the adjacent floor joists.

2. The method of claim 1 wherein the support block has:

a. its block length extending between adjacent floor joists, and b. a drain body situated within the block hole.

3. The method of claim 2 wherein:

a. a countersink is defined in one of the block faces about the block hole, b. the drain body has an upper flange situated within the countersink.

4. The method of claim 1 wherein the support block is situated beneath a shower base having a drain hole therein, with the block hole and the drain hole being at least substantially concentrically aligned.

5. The method of claim 1 wherein the support block further has a countersink defined in one of the block faces about the block hole, the countersink:

a. being at least 0.125 inches deep, and b. having an outer diameter at least 0.5 inches greater than the outer diameter of the block hole.

6. The method of claim 1 wherein the support block is provided in combination with first and second cleats, each cleat having:

a. opposing cleat side surfaces, and b. a cleat support surface therebetween, the cleat support surface being configured to support one of the block faces at one of the block ends.

7. The method of claim 6 wherein each cleat support surface is rabbeted between the cleat support surface and at least one of the cleat side surfaces.

8. The method of claim 6 wherein each cleat:

a. is affixed to a respective floor joist, and b. is below one of the block ends, with one of the block faces in abutment with the cleat support surface.

9. The method of claim 1:

a. wherein the block length is at least 20 inches, b. wherein the block hole has an outer diameter:

(1) of at least 3.75 inches, (2) spaced at least 5¼ inches from one of the block ends.

10. The method of claim 1 further including the steps of:

a. fitting a drain body within the block hole, b. placing the shower base atop the floor joists with a drain hole in the shower base aligned with the drain body.

11. The method of claim 1 further including the steps of:

a. installing first and second cleats on the adjacent floor joists, with each cleat having:

(1) opposing cleat side surfaces, and (2) a cleat support surface therebetween, with each cleat being affixed to a respective one of the floor joists, b. fitting the block between the adjacent floor joists with each block end resting atop a respective one of the cleat support surfaces.

12. The method of claim 1 further including the steps of:

a. before cutting the block, mapping a drain hole location atop the floor joists, the drain hole location being a location at which a drain hole in the shower base is to be situated following installation of the shower base upon the floor joists, b. thereafter fitting the block between the adjacent floor joists with the block hole aligned with the drain hole location.

13. The method of claim 1 further including the steps of:

a. situating the block atop the adjacent floor joists with the block length extending between the joists, b. marking one of the block faces at block cutting locations situated immediately adjacent the floor joists, b. thereafter cutting the block across the block width at the block cutting locations to adjust the block length to closely fit between the adjacent floor joists.

14. A drain support block formed of cuttable material, the block having:

a. a block length of at least 13 inches and at most 24 inches, b. a block width of at least 6 inches, c. a block depth of at least 0.5 inches, d. opposing block faces extending along the block length and the block width, e. opposing block ends situated between the block faces, the block ends extending along the block width and block depth, f. opposing block sides situated between the block faces and between the block ends, the block sides extending along the block length and block depth, g. a block hole extending between the block faces, the block hole having an outer diameter of at least 1.5 inches, h. a countersink defined in one of the block faces about the block hole, the countersink:

(1) being at least 0.125 inches deep, and (2) having an outer diameter at least 0.5 inches greater than the outer diameter of the block hole.

15. The drain support block of claim 14 affixed between adjacent floor joists.

16. The drain support block of claim 14 further including:

a. a drain body situated within the block hole, b. a shower base upon the block face having the countersink defined therein, the shower base including a drain hole therein, with the drain hole being aligned with the drain body.

17. A drain support block having:

a. a block length extending between opposing block ends, each block end being situated against a respective one of two adjacent floor joists, b. a block width extending between opposing block sides, the block sides extending between the block ends, c. a block depth extending between opposing block faces, the block faces extending between the block ends and block sides, d. a block hole extending between the block faces, e. a drain body situated within the block hole, f. a shower base situated atop one of the block faces, the shower base having a drain hole aligned with the drain body.

18. The drain support block of claim 17 wherein:

a. the block face having the shower base situated atop has a countersink defined therein about the block hole, b. the drain body has an upper flange situated within the countersink.

* * * * *